US006148630A

United States Patent [19]

Saccone

[11] Patent Number: 6,148,630

[45] Date of Patent: Nov. 21, 2000

[54] EASY INSTALLATION SINGLE-UNIT AIR CONDITIONER

[75] Inventor: Roberto Saccone, Brescia, Italy

[73] Assignee: Olimpia Splendid S.p.A., Gualtieri, Italy

[21] Appl. No.: 09/357,912

[22] Filed: Jul. 21, 1999

[30] Foreign Application Priority Data

Jul. 30, 1998 [IT] Italy ..... RE98U0039

[51] Int. Cl.[7] ..... F25D 23/12

[52] U.S. Cl. ..... 62/263; 62/259; 62/452

[58] Field of Search ..... 62/428, 259.1, 62/263, 452, 455, 454

[56] References Cited

U.S. PATENT DOCUMENTS

| | | | |
|---|---|---|---|
| 3,777,506 | 12/1973 | Hergatt et al. | 62/237 |
| 4,132,088 | 1/1979 | Grosskopf | 62/298 |
| 4,811,570 | 3/1989 | Jennings et al. | 62/263 |
| 4,901,538 | 2/1990 | Anthony | 62/237 |
| 5,697,226 | 12/1997 | Marchesi | 62/263 |

FOREIGN PATENT DOCUMENTS

| | | | |
|---|---|---|---|
| 57-431 | 1/1982 | Japan | 62/263 |
| 58-129121 | 8/1983 | Japan | 62/428 |
| 60-223926 | 11/1985 | Japan | 62/263 |
| 1-163536 | 6/1989 | Japan | 62/263 |
| 6-50563 | 2/1994 | Japan | 62/263 |

*Primary Examiner*—William Doerrler
*Assistant Examiner*—Melvin Jones
*Attorney, Agent, or Firm*—Browdy and Neimark

[57] ABSTRACT

Air conditioner comprising a condenser unit (1), through which a flow of external air passes between an inlet section (3) and an outlet section (4), and an evaporation unit (2), through which a flow of internal air passes between an inlet section (5) and an outlet section (6), wherein the condenser unit (1) is provided with at least two connections with the exterior (8) designed to mate with small-diameter circular holes (7) communicating with the external environment.

10 Claims, 2 Drawing Sheets

EASY INSTALLATION SINGLE-UNIT AIR CONDITIONER

BACKGROUND OF THE INVENTION

1. Field of the Invention

The present patent relates to an easy installation single-unit air conditioner. The present patent comes under the sector of single-unit air conditioners which are autonomous, namely contain all the operating components within a single volume, and, during operation, perform ventilation of a room.

2. Description of the Prior Art

Different types of air conditioners are known and can be basically classified in two categories: split-system conditioners and single-unit conditioners. Split-system conditioners comprise two separate units, one of which must be arranged inside and the other outside the rooms. The internal units may be both of the floor and of the wall or ceiling type. The connection between the two is provided by means of copper refrigerating pipes.

The installation of split-system conditioners has therefore proved to be somewhat complex and costly since it involves hydraulic and electrical work as well as the laying of copper refrigerating pipes, the construction of air ducts and masonry work. Moreover, since it is necessary to position the condenser unit outside the rooms, the effect from an esthetic point of view may be negative.

Conditioners of the single-unit type combine all the components in a single structure, but must nevertheless ensure the connection with the exterior. Single-unit window conditioners, which are generally mounted on wheeled carriages, are known. In this case it is necessary to form in the glass one or two large-diameter holes.

Since it is necessary to position the conditioners on carriages in order to be able to connect them to the exterior via the hole in the glass, the structure is particularly subject to vibrations and consequently this type of single-unit conditioner is somewhat noisy.

In all these cases installation proves to be problematic both in terms of complexity and in terms of costs; moreover the outcome, esthetically speaking, is often unsatisfactory both when the conditioner is in use and in the case where it must be disassembled.

Single-unit conditioners of the "transferable" type have only one outlet tube to the exterior and have major functional shortcomings in that they create a vacuum in the room where they operate, resulting in a recall of external air, with a consequent low performance in terms of energy and operation.

The object of the present patent is that of eliminating the abovementioned drawbacks and providing a single-unit air conditioner with two separate flows of air to the condenser and to the evaporator, which simplifies considerably the problems associated with installation.

SUMMARY OF THE INVENTION

Said objects are fully achieved by the easy installation single-unit air conditioner with separate flows of air to the condenser and to the evaporator, according to the invention, as described by the contents of the claims indicated below.

In particular the condenser unit, which is intended for the exchange of heat with the external air, has two sections: an inlet section and the other an outlet section for the external air, consisting of at least two stub pipes which are intended to mate with small-diameter circular holes which connect the internal environment to the external environment.

In fact, in addition to the possibility of eliminating the need to find an external space for positioning voluminous and unesthetic condenser units, the connection to the exterior is rapid and simple since it requires only two small-diameter circular holes formed in the wall by means of commonly used milling cutters.

In addition the conditioner according to the present invention may be left mounted in the fixed condition or may be easily removed by closing the external outlets with suitable caps.

Moreover the condenser unit, which is designed for the exchange of heat with the external air, and the evaporator unit, which is designed for conditioning of the internal air, are assembled together in a single unit, while keeping, however, the two respective flows of air separate.

In a particular embodiment the evaporation unit is located directly underneath the condenser unit. It is nevertheless possible to use the conditioner according to the present model as a "split system", having a condenser unit which must be inserted inside the dwelling in a remote position and in any case connected to the exterior by means of mating with small-diameter circular holes.

BRIEF DESCRIPTION OF THE DRAWINGS

These and other characteristic features will emerge more clearly from the following description of a preferred embodiment illustrated, purely by way of a non-limiting example, in the accompanying plates of drawings in which.

Figure 1:
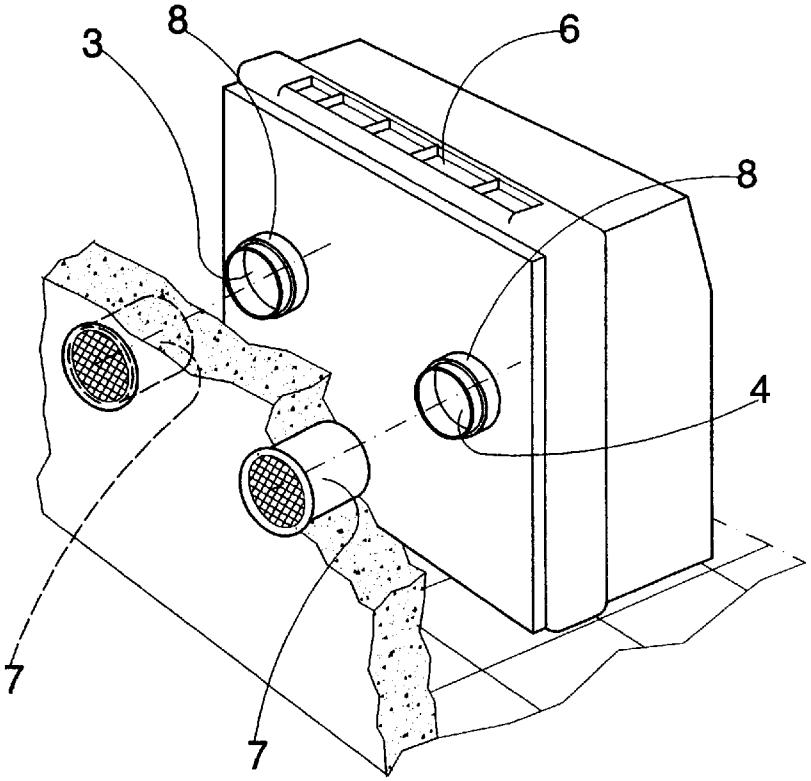
FIG. 1 shows a perspective view of the conditioner during installation.
Figure 2:
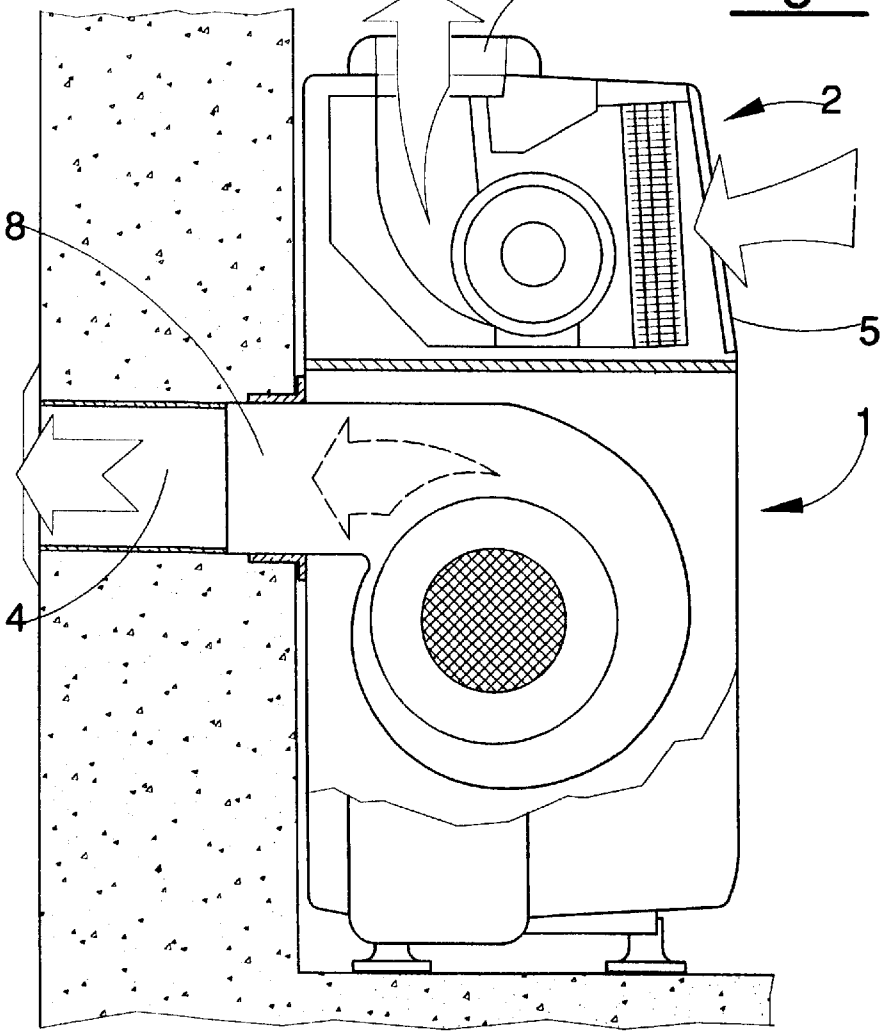
FIG. 2 shows a laterally sectioned view of the conditioner as a whole, with the evaporation unit located directly above the condenser unit.

With reference to the FIGS. 1 and 2 denote respectively a condenser unit and an evaporation unit, viewed as a whole.

In the solution shown in the figures, the evaporation unit 2 is located directly above the condenser unit 1. The condenser unit 1 is intended for the exchange of heat with the external air which passes through it between an inlet section 3 and an outlet section 4.

Figure 4:
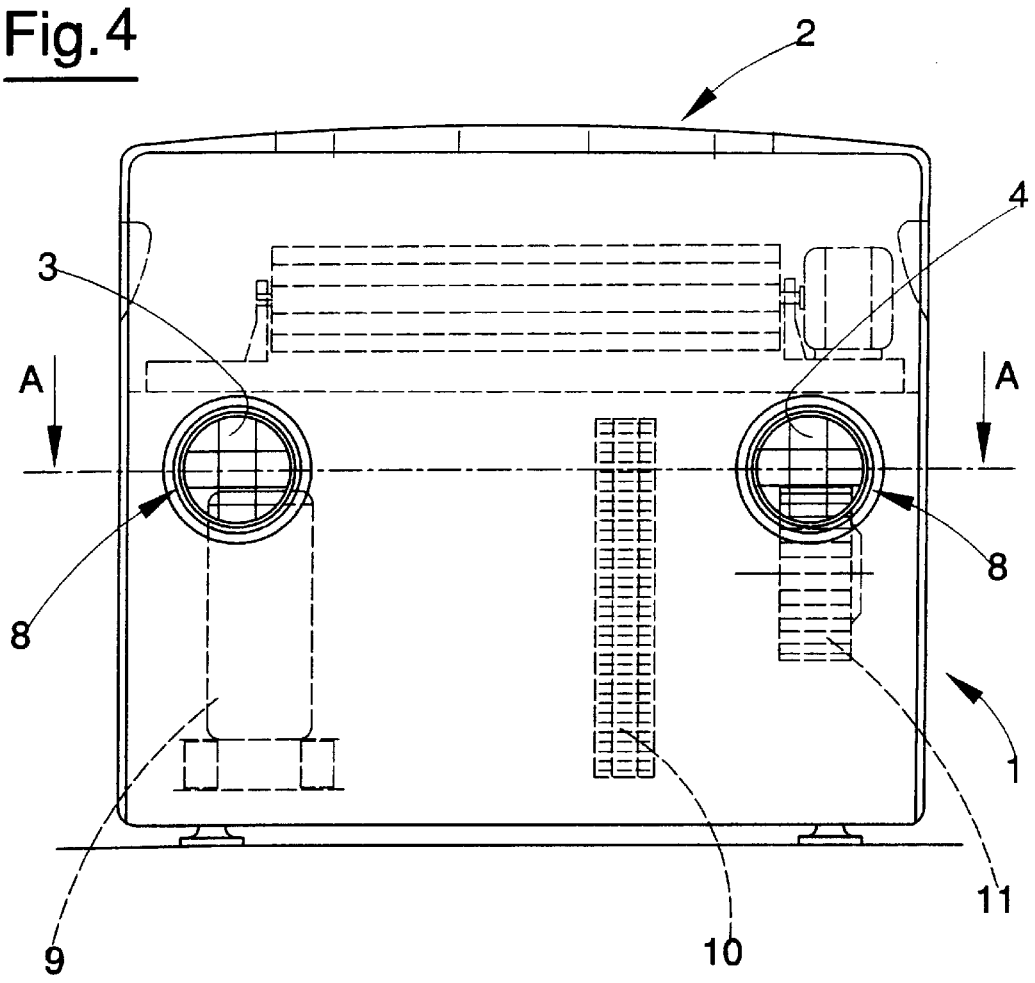
FIG. 4 shows a rear elevation view of the conditioner, in its entirety, partially sectioned.
Figure 3:
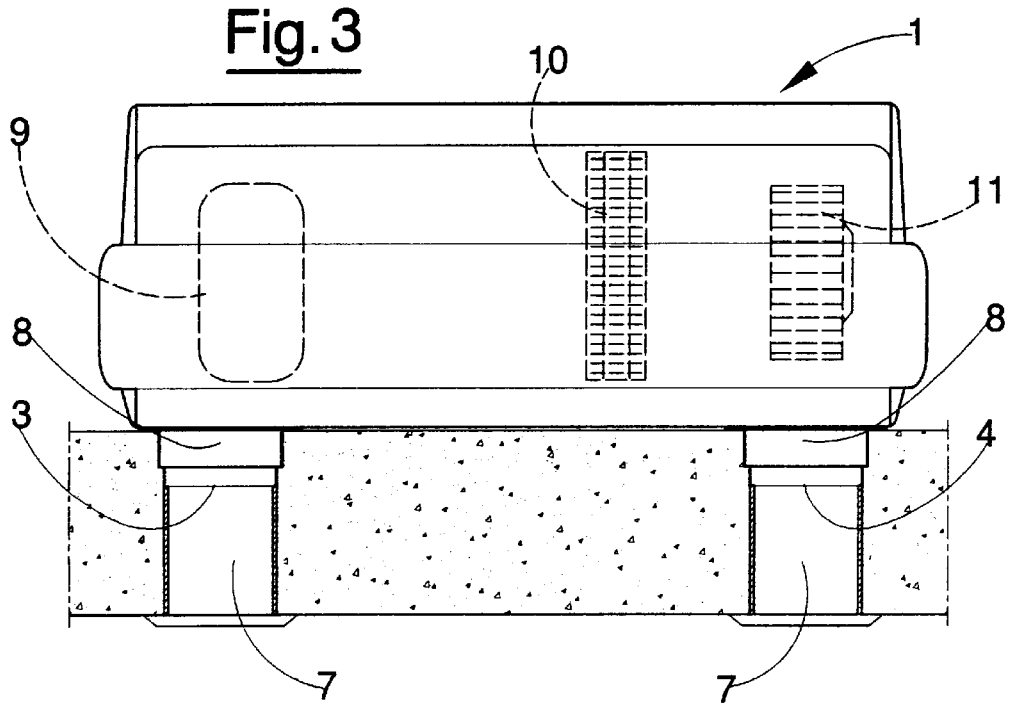
FIG. 3 shows a cross-section through the installed conditioner along the plane A—A viewed from above, with the condenser unit visible.

The structure of the condenser unit 1 is substantially of the known type. As schematically shown in FIGS. 3 and 4, it contains, in fact, a compressor 9, a refrigerating fluid/external air exchanger 10, a fan 11 and a system for automatic vaporization of the condensation water, not shown in the Figure.

The sections communicating with the exterior, namely the inlet section 3 and the outlet section 4 for the air, are formed with external connections 8 consisting of stub pipes projecting from the housing of the conditioner, so as to be able to mate easily with the circular holes 7 communicating with the exterior.

The evaporation unit 2 is designed for conditioning of the internal air which flows through it, passing from an inlet section 5 to an outlet section 6. The evaporation unit 2 also consists of known elements and in fact comprises a heat exchanger for the air/refrigerating fluid, an electric heating resistance, a fan for recirculation of the air and a filter for purification of the air itself, schematically shown in the figures, but not numbered.

The connections 8, with the exterior, of the condenser unit 1 are formed in particular as circular stub pipes with a small diameter, by way of guidance having a value ranging from 75 to 150 mm (respectively corresponding to the conventional units of measurement of 3" to 6"), and having horizontal and parallel axes, such that they can be easily connected to the circular holes 7 formed in the wall.

A preferred value of the diameter of these holes 8 corresponds to about 100 mm, i.e. 4" in the conventional units of measurement.

It is sufficient, in fact, to form in the wall communicating with the exterior two corresponding small-diameter circular holes 7 which can be formed by means of an ordinary low-power core milling cutter. By means of these holes 7 the external connections 8 representing respectively the air inlet section 3 and outlet section 4 of the condenser unit 1 are connected to the exterior, as shown in FIG. 1.

The installation of the conditioner is particularly easy and may be performed rapidly, with building work which is less intrusive from an esthetic point of view and hence with lower costs compared to known conditioners. The conditioner thus installed does not pose the problem of positioning of the external unit, while rigorously maintaining operation with two separate flows to the condenser and to the evaporator.

Moreover the conditioner may be easily removed and transported, while the holes in the wall may be simply closed with caps, without any negative effect from a functional or esthetic point of view.

Shown in the example with the connections 8 arranged alongside each other and parallel, the invention, according to a variant, may consist of connections 8 which are arranged above each other or each doubled so as to form smaller circular holes, the solution of connecting the condenser unit 1 of a conditioner to the exterior by means of a plurality of small-diameter circular holes remaining within the scope of the innovative idea.

By way of a further variant, the invention may be applied to a split unit, in which the condenser unit 1 is installed inside the room and communicates with the exterior by means of a plurality of small-diameter circular holes provided in the associated casing.

Finally, the stub pipes 8 may, by way of a further variant, be replaced by simple annular pressure seals made of elastomeric material, without thereby departing from the protective scope of the invention.

What is claimed:

1. Air conditioner comprising a condenser unit (1), through which a flow of external air passes between an inlet section (3) and an outlet section (4), and an evaporation unit (2), through which a flow of internal air passes between an inlet section (5) and an outlet section (6), wherein the condenser unit (1) is provided with at least two connections with the exterior (8) representing respectively the inlet section (3) and the outlet section (4) for the air and designed to mate with corresponding holes (7) communicating with the external environment.

2. Air conditioner as claimed in claim 1, wherein the connections to the exterior (8) consist of circular holes, the diameter of which ranges between 75 and 150 mm.

3. Air conditioner as claimed in claim 1, wherein the connections to the exterior (8) consist of circular stub pipes provided on the external housing of the conditioner and located on the same side.

4. Air conditioner as claimed in claim 1, wherein the connections to the exterior (8) consist of annular seals made of elastomeric material.

5. Air conditioner as claimed in claim 1, wherein the connections to the exterior (8) are positioned with axes which are horizontal and parallel and at the same distance from the resting point of the conditioner.

6. Air conditioner as claimed in claim 1, wherein the connections to the exterior (8) are positioned with the axes horizontal and parallel and arranged above each other.

7. Air conditioner as claimed in claim 1, wherein the connections to the exterior (8) are doubled so as to form a plurality of smaller circular holes.

8. Air conditioner as claimed in claim 1, wherein the condenser unit (1) and the evaporation unit (2) are assembled together as a single unit so that the respective air flows are separate.

9. Air conditioner as claimed in claim 7, wherein the evaporation unit (2) is positioned immediately above the condenser unit (1).

10. Air conditioner as claimed in claim 1, wherein the condenser unit (1) and the evaporation unit (2) are separate.

* * * * *

US006148630C1

(12) EX PARTE REEXAMINATION CERTIFICATE (6071st)

United States Patent
Saccone

(10) Number: US 6,148,630 C1
(45) Certificate Issued: Jan. 1, 2008

(54) EASY INSTALLATION SINGLE-UNIT AIR CONDITIONER

(75) Inventor: Roberto Saccone, Brescia (IT)

(73) Assignee: Olimpia Splendid S.p.A., Gualtrieri (IT)

Reexamination Request:
No. 90/006,960, Mar. 10, 2004

Reexamination Certificate for:

| | |
|---|---|
| Patent No.: | **6,148,630** |
| Issued: | **Nov. 21, 2000** |
| Appl. No.: | **09/357,912** |
| Filed: | **Jul. 21, 1999** |

(30) Foreign Application Priority Data

Jul. 30, 1998 (IT) ..... RE98U0039

(51) Int. Cl.
*F25D 23/12* (2006.01)
*F25D 23/10* (2006.01)

(52) U.S. Cl. ..... 62/263; 62/259.1; 62/452

(58) Field of Classification Search ..... None
See application file for complete search history.

(56) References Cited

U.S. PATENT DOCUMENTS

| | | | | |
|---|---|---|---|---|
| 2,660,866 A | | 12/1953 | Tipton et al. | |
| 2,660,867 A | | 12/1953 | Borgerd | |
| 2,667,765 A | | 2/1954 | Harris et al. | |
| 2,717,508 A | | 9/1955 | Loveley et al. | |
| 2,722,810 A | * | 11/1955 | Maniscalco, Sr. | 62/279 |
| 2,945,357 A | * | 7/1960 | MacLeod | 62/262 |
| 3,602,006 A | | 8/1971 | Metcalfe | |
| 3,665,726 A | | 5/1972 | Preotle | |
| 4,067,204 A | * | 1/1978 | Riello | 62/262 |
| 4,242,876 A | | 1/1981 | Cooper et al. | |
| 4,389,853 A | | 6/1983 | Hile | |
| 4,462,539 A | | 7/1984 | Gilson | |

FOREIGN PATENT DOCUMENTS

| | | | |
|---|---|---|---|
| CA | 2 110 339 | | 2/1994 |
| DE | 28 31 651 | | 1/1980 |
| DE | 44 12 844 | | 8/1995 |
| EP | 0 257 017 | | 2/1991 |
| EP | 0 756 140 | | 1/1997 |
| EP | 756140 | A2 * | 1/1997 |
| FR | 2 502 308 | | 9/1982 |
| FR | 2 581 739 | | 11/1986 |
| GB | 1 804 494 | | 12/1959 |
| IT | 351739 | | 3/1961 |
| JP | 60108620 | | 6/1985 |
| JP | 60162136 | | 8/1985 |
| WO | 88/08944 | | 11/1988 |

* cited by examiner

*Primary Examiner*—Michael O'Neill

(57) ABSTRACT

Air conditioner comprising a condenser unit (1), through which a flow of external air passes between an inlet section (3) and an outlet section (4), and an evaporation unit (2), through which a flow of internal air passes between an inlet section (5) and an outlet section (6), wherein the condenser unit (1) is provided with at least two connections with the exterior (8) designed to mate with small-diameter circular holes (7) communicating with the external environment.

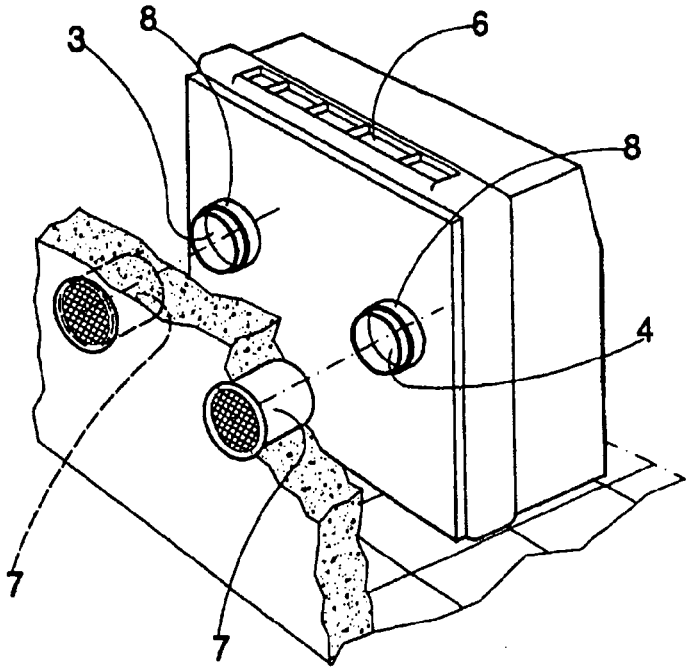

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–10 are cancelled.

* * * * *